US009003591B2

(12) United States Patent
Sakashita et al.

(10) Patent No.: US 9,003,591 B2
(45) Date of Patent: Apr. 14, 2015

(54) PRESSURE-SENSITIVE ADHESIVE CLEANER FOR PLATE SURFACES

(75) Inventors: Teiji Sakashita, Tokyo (JP); Satoshi Taguchi, Tokyo (JP); Aya Nagatomo, Ibaraki (JP)

(73) Assignees: Kabushiki Kaisha Nitoms, Tokyo (JP); Nitto Denko Corporation, Osaka (JP)

( * ) Notice: Subject to any disclaimer, the term of this patent is extended or adjusted under 35 U.S.C. 154(b) by 60 days.

(21) Appl. No.: 13/813,214

(22) PCT Filed: Jun. 29, 2012

(86) PCT No.: PCT/JP2012/066808

§ 371 (c)(1), (2), (4) Date: Jan. 30, 2013

(87) PCT Pub. No.: WO2013/015075

PCT Pub. Date: Jan. 31, 2013

(65) Prior Publication Data

US 2013/0125322 A1 May 23, 2013

(30) Foreign Application Priority Data

Jul. 26, 2011 (JP) ..... 2011-163521

(51) Int. Cl.
*A47L 25/00* (2006.01)
*B08B 7/00* (2006.01)

(52) U.S. Cl.
CPC ..... *A47L 25/005* (2013.01); *B08B 7/0028* (2013.01)

(58) Field of Classification Search
CPC ..... A47L 25/005; B08B 7/0028
USPC ..... 15/104.002, 48, 41.1; 428/40.1
See application file for complete search history.

(56) References Cited

U.S. PATENT DOCUMENTS

| | | | | |
|---|---|---|---|---|
| 7,005,183 | B2 * | 2/2006 | Kondo | 428/343 |
| 7,137,165 | B2 * | 11/2006 | Shizuno et al. | 15/104.002 |
| 2003/0167583 | A1 | 9/2003 | Shizuno et al. | |
| 2009/0301519 | A1 | 12/2009 | Aubay | |
| 2012/0263948 | A1 * | 10/2012 | Amano et al. | 428/355 AC |

FOREIGN PATENT DOCUMENTS

| | | | |
|---|---|---|---|
| CN | 101518434 | A | 9/2009 |
| JP | 7-116623 | A | 5/1995 |
| JP | 7-171530 | A | 7/1995 |

(Continued)

OTHER PUBLICATIONS

Notice of Reasons for Rejection issued in corresponding JP Application No. 2013-503900, dated Nov. 14, 2013.

(Continued)

*Primary Examiner* — Shay Karls
(74) *Attorney, Agent, or Firm* — Sughrue Mion, PLLC

(57) ABSTRACT

Provided is a cleaner that can easily and efficiently remove organic dirt accumulated on a flat plate surface such as a display-input member (touch panel member) in a portable device. The cleaner (10) provided by the present invention is a pressure-sensitive adhesive plate surface cleaner (10) that comprises a pressure-sensitive adhesive body (30) having a removable pressure-sensitive adhesive and is used so as to allow the pressure-sensitive adhesive body (30) to contact a flat plate surface (2) of a plate such as a portable device (1) having a flat surface in order to remove organic dirt accumulated on the plate surface (2).

15 Claims, 8 Drawing Sheets

(56) References Cited

FOREIGN PATENT DOCUMENTS

| | | | |
|---|---|---|---|
| JP | 2001-29307 | A | 2/2001 |
| JP | 2004-237023 | A | 8/2004 |
| JP | 2009-503161 | A | 1/2009 |
| KR | 10-2010-0127484 | A | 0/2001 |
| WO | 03/099098 | A1 | 12/2003 |

OTHER PUBLICATIONS

Communication dated Jun. 12, 2014, issued by the Japan Patent Office in corresponding application No. 2013-503900.

Notice of Allowance dated Feb. 5, 2015 from the Japanese Patent Office in counterpart application No. 2013-503900.

Extended Search Report dated Mar. 6, 2015 from the European Patent Office in counterpart application No. 12817172.5.

* cited by examiner

PRESSURE-SENSITIVE ADHESIVE CLEANER FOR PLATE SURFACES

CROSS REFERENCE TO RELATED APPLICATIONS

This application is a national stage of PCT/JP2012/066808 filed Jun. 29, 2012, which claims priority based on Japanese Patent Application No. 2011-163521 filed Jul. 26, 2011; the contents of all of which are incorporated herein by reference in their entirety.

TECHNICAL FIELD

The present invention relates to a pressure-sensitive adhesive (PSA) cleaner for removing dust and dirt. In particular, it relates to a PSA cleaner for removing dirt consisting of sebum and other organic substances from flat plate surfaces such as display-input screens set in portable PCs and high-tech mobile phones. The present application claims priority based on Japanese Patent Application No. 2011-163521 filed on Jul. 26, 2011, and the entire contents of the application are incorporated in this description as reference.

BACKGROUND ART

In late years, use of portable devices such as notebook PCs, tablet PCs, PDAs (personal digital assistants), and smartphones is rapidly growing. These portable devices include display members (displays) typically comprising liquid crystal panels or organic electro-luminescence panels. The surfaces (display screens) of such display members are constituted with flat plates typically made of high impact glass or a synthetic resin (plastic).

Incidentally, since these portable devices are put to use while users carry them on a daily basis according to their lifestyles or business styles, they are likely to accumulate dust and dirt, especially dirt consisting of an organic substance such as hand marks, cosmetics, sedum or the like. In particular, among the latest portable devices, some devices are constructed with touch panels so that the displays work as input screens as well. Such touch-panel display-input screens are more likely to accumulate organic substances such as hand marks and sedum, etc., since users directly touch the plate surfaces (display screens) with fingers. Thus, for plate surfaces (display screens) constituting display-input members in devices of this type, a cleaning means (cleaner) that can rapidly and easily remove not just lint and dust, but also organic dirt such as hand marks and sedum, etc., in particular is in desire.

Conventionally, as a cleaning means to remove dirt on such display screens, waste cloths made of paper, a woven fabric, or a non-woven fabric have been used. However, while waste cloths are conveniently used, they gradually accumulate oily dirt if they are continually used, requiring periodical washing or an exchange with a new piece, and this could be a bother.

An alternative means to remove organic dirt, lint and dust involves wiping of plate surfaces (display screens) with a suitable material (e.g., sponge or gauze) wet with an appropriate cleaning agent (e.g., see Patent Document 1). However, besides it requires caution in handling the cleaning agent, immediately after the wiping, touch panel operation may become difficult due to the wet plate surface. It is also a concern that the plate surface may be affected with the cleaning agent remaining thereon. Thus, a simple and sure dirt-removing (cleaning) means other than using a cleaning agent is in desire.

CITATION LIST

Patent Literatures

[Patent Document 1] Japanese Translation of PCT International Application No. 2009-503161

[Patent Document 2] Japanese Patent Application Publication No. 2004-237023

SUMMARY OF INVENTION

Technical Problem

The present invention was made to solve such a conventional problem. An objective thereof is to provide a cleaner for easy and efficient removal of not just lint and dust, but also organic dirt (e.g., hand marks, cosmetics, sedum dirt) accumulated on a flat plate surface (display screen) such as a display-input member (touch panel member) in a portable device as described above.

Solution to Problem

In order to achieve the objective, the present invention provides a PSA plate surface cleaner comprising a PSA body that has a removable PSA, and the cleaner being used so as to allow the PSA body to contact a flat plate surface of a plate having a flat surface in order to remove organic dirt accumulated on the plate surface. In a preferable embodiment, the cleaner further comprises a support for supporting the PSA body.

The PSA plate surface cleaner (dirt remover) disclosed herein is characterized by removing organic dirt (e.g., hand marks and sedum dirt of a person, or cosmetics) on a plate surface with the PSA body comprising a removable PSA. According to a cleaner having such a constitution, by allowing the PSA body to contact a plate surface, dust and organic dirt (e.g., hand marks and sedum dirt of a person) accumulated on the plate surface are caught on the PSA body and removed from the plate surface. Thus, unlike the case using a cleaning agent, dirt, especially sedum dirt of a person, on a plate surface can be easily removed without any complex procedures (e.g., preparation of a composition containing a cleaning solution).

Thus, the PSA plate surface cleaner disclosed herein is used on a portable device comprising as a flat plate surface a display screen (which can be referred to as an input screen in a touch panel system, etc.) made of glass or a synthetic resin in order to remove organic dirt accumulated on the display screen. The PSA plate surface cleaner disclosed herein is preferably used for removing human sedum dirt in particular as organic dirt.

In "organic dirt", as evident from that sedum secreted from skin is included as described above, inorganic substances such as sodium, potassium, or their salts, etc., may be contained.

In a preferable embodiment of the PSA plate surface cleaner disclosed herein, the cleaner is characterized by comprising a support for supporting the PSA body, with the support being constituted to hold the PSA body such that while the PSA is pushed against the plate surface, the PSA body can be rolled along the plate surface.

According to a cleaner having such a constitution, by rolling the support, dirt (especially organic dirt such as hand marks and sedum of a person) on a flat plate surface having a prescribed area can be efficiently removed.

Preferably, the support is characterized by that it is designed such that it has a cylindrical form, with the cylindrical support comprising the PSA body on its lateral surface, wherein the cylindrical support has an outside diameter of at least 4 mm or larger.

According to a so-called roller cleaner comprising such a cylindrical support, by rolling (rotationally moving) the support into a prescribed direction on a plate surface, dirt on the flat plate surface having a prescribed area can be removed even more efficiently. It is noted that an adhesive cleaner has been conventionally used (e.g., see Patent Document 2), such a conventional roller cleaner is intended to clean floors and carpets, but not flat plate surfaces such as touch panel screens (display-input members) in portable devices (e.g., PDAs and tablet PCs) as described above.

Preferably, the PSA body is characterized by that it comprises a substrate sheet and the PSA is held on a face of the substrate sheet to form a PSA sheet, and it is constituted as a PSA sheet roll wound with the PSA on the outside. The substrate sheet is preferably constituted with a synthetic resin, non-woven fabric or paper.

With a PSA plate surface cleaner having such a constitution, the lateral surface of the wound PSA sheet roll can be used to remove dirt on a plate surface, and depending on the usage and the amount of dust and dirt caught on the PSA body constituting the lateral surface, a portion of the lateral surface used for dust removal can be taken (peeled) away from the sheet roll so as to easily expose a fresh PSA surface on the lateral surface. Because of this, a desirable dirt-removing ability can be consistently maintained.

Preferably, the PSA sheet roll provided by the present invention is constituted to deter rail drawing phenomenon. Rail drawing herein refers to a phenomenon such that when a PSA sheet roll is rolled (rotated) reversely to the winding direction (i.e., in a direction that the wound PSA sheet is going to be unwrapped) on a surface to be cleaned (a flat plate surface with respect to the present invention), a band of the PSA sheet stays stuck on the surface to be cleaned, beginning from the end of the PSA sheet roll on the lateral surface.

By deterring rail drawing, the PSA sheet roll can be rolled smoothly on a flat plate surface without any stress; and therefore, sedum and other organic dirt on the plate surface can be removed efficiently and quickly. In addition, wasting of the PSA sheet due to an occurrence of rail drawing (i.e., wasting of the PSA sheet due to involuntary adhesion of the PSA body to a flat plate surface) can be prevented.

In a preferable embodiment of the PSA plate surface cleaner disclosed herein, the PSA is characterized by being an acrylic PSA, a natural-rubber-based PSA, or a urethane-based PSA.

By employing a PSA of these types, organic dirt (especially sedum dirt) can be efficiently removed.

In another preferable embodiment of the PSA plate surface cleaner disclosed herein, the PSA body is characterized by exhibiting a peel strength of 1 N/25 mm to 7 N/25 mm as a measured value based on the 180° peel test specified in JIS Z0237.

Such an adhesive strength can deter the cleaner itself from sticking to a plate surface too strongly, thereby allowing efficient removal of organic dirt from the flat plate surface. Thus, it can be preferably used for removing dirt on plate surfaces (typically, flat display screens made of glass or a synthetic resin) of portable devices (e.g., tablet PCs and PDAs).

DESCRIPTION OF EMBODIMENTS

Preferred embodiments of the present invention are described below. Matters necessary to practice this invention other than those specifically referred to in this description may be understood as design matters to a person of ordinary skill in the art based on the conventional art in the pertinent field. The present invention can be practiced based on the contents disclosed in this description and technical common knowledge in the subject field.

Unlike conventional PSA cleaners used for cleaning floors or carpets, the PSA plate surface cleaner disclosed herein is characterized by its preferable usage for removing dirt from flat plate surfaces such as display screens in various types of portable devices.

An object on which the PSA plate surface cleaner of the present invention is used is not particularly limited as long as it is a flat plate surface (typically a plate surface made of glass or a synthetic resin). For example, preferable examples include display screens in display systems such as liquid crystal displays, organic EL displays, and the like. Other examples of the "flat plate surface" referred to herein include surfaces of display windows, glass tables, display cases, and the like.

Examples of a preferable object on which the PSA plate surface cleaner of the present invention is used include surfaces (especially display-input screens) of various portable devices. "Portable device" here refers to a mobile device comprising a flat plate surface (i.e., a surface to which the PSA plate surface cleaner of the present invention can be applied) at least partially on its exterior, but not limited to a specific device. For example, notebook PCs of various sizes, tablet PCs, PDAs (personal digital assistants) such as electronic organizers, smartphones and other mobile phones, hand-held game consoles, and the like are included in the portable device.

There are no particular limitations on the form of the PSA plate surface cleaner disclosed herein as long as it comprises a PSA body having a removable PSA and it is able to remove organic dirt (especially sedum and hand marks of a person) when the PSA body is allowed to contact flat plate surfaces. For example, the PSA plate surface cleaner may be a sheet or a patch comprising a layer (single layer or multiple layers) formed of a PSA body and a support for supporting the PSA body. Preferably, the cleaner comprises a cylindrically-formed support (roll core), and further comprises a rolled PSA body. PSA plate surface cleaner 10 in such a preferable embodiment is described with reference to FIGS. 1 to 4 below.

Figure 1:
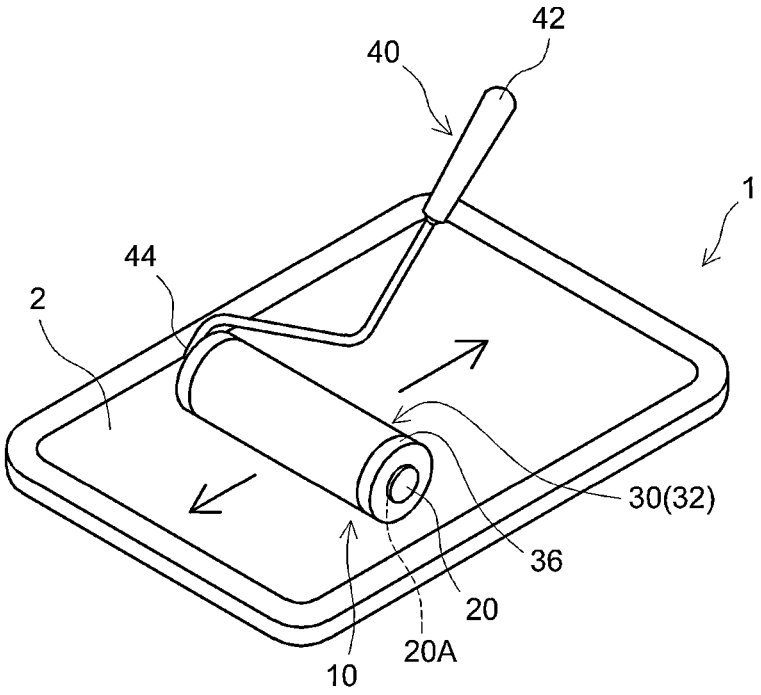
FIG. 1 shows a perspective view schematically illustrating an example of usage of a PSA plate surface cleaner according to an embodiment of the present invention.

As shown in FIG. 1, cleaner 10 according to a first embodiment is used on portable device 1 comprising flat plate surface 2 in order to remove dirt on plate surface (herein, display constituting a touch panel) 2. Portable device 1 is a tablet PC with its entire outer surface being constituted with a flat tempered glass such as aluminosilicate glass, or the like.

Cleaner 10 according to the present embodiment comprises cylindrically-formed support (roll core) 20, rolled PSA body (PSA sheet roll) 30 wound around the lateral surface of support 20, and bar handle member 40 to which support 20 and PSA body 30 are rollably attached. Rotatable head spindle 44 at an opposite end of handheld portion 42 of handle member 40 is attached so as to pass through central opening 20A of cylindrical support 20.

Figure 2:
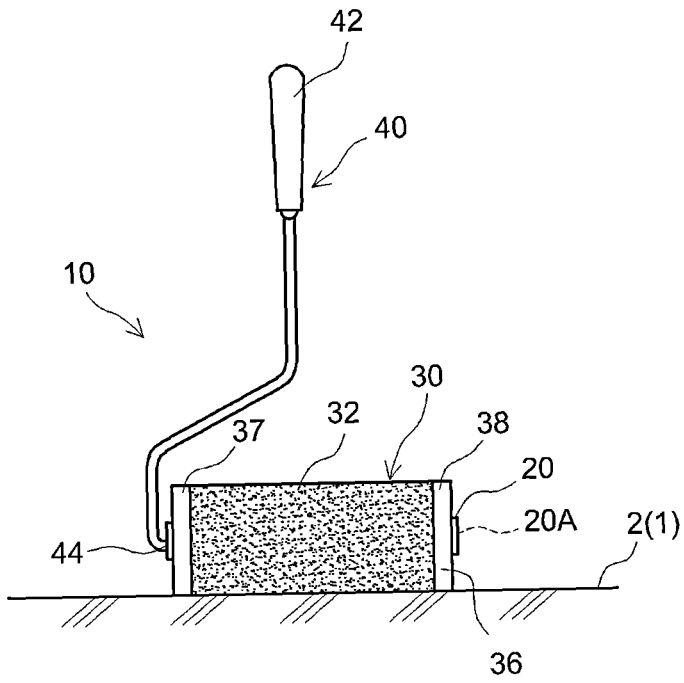
FIG. 2 shows a front elevation schematically illustrating an example of usage of a PSA plate surface cleaner according to an embodiment of the present invention.
Figure 3:
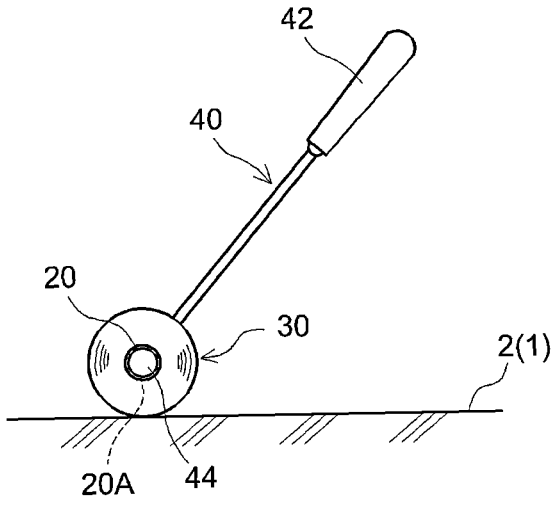
FIG. 3 shows a side view schematically illustrating an example of usage of a PSA plate surface cleaner according to an embodiment of the present invention.

As shown in FIGS. 1 to 3, with such a constitution, cleaner 10 according to the present embodiment operates such that when an operator (not shown) holds handle member 40 and apply a prescribed external force to cleaner 10, the external force is transmitted from handle member 40 via head spindle 44 to support 20, and while PSA body (PSA sheet roll) 30 placed on the lateral surface of support 20 is allowed to contact plate surface 2 with a suitable pressing force, PSA body 30 rolls into a prescribed direction along plate surface 2. During this, because of the adhesive strength, etc., of PSA body 30, dust and organic dirt, especially hand marks and sedum of a person, present on plate surface 2 are transferred to PSA body 30, that is, trapped to the PSA body 30 side. This allows efficient and quick cleaning (dirt removal) of plate surface 2 along the rolling direction of PSA body 30.

Although cleaner 10 according to the present embodiment is used for removing (cleaning) organic dirt accumulated on flat plate surface 2 in portable device 1 or any other device, how a user actually uses cleaner 10 according to the present embodiment (i.e., the way an operator navigate cleaner 10 by holding handle member 40) is the same as how one uses a conventional roller cleaner for removing lint and dust from carpets and floors; and therefore, a user can easily use cleaner 10 according to the present invention.

Preferably, PSA body (PSA sheet roll) 30 comprises a cut (not shown) for separation for approximately every circumference. This cut makes a cutting means to facilitate replacement of the lateral surface (working surface) of the PSA body upon reduction of the cleaning (dirt-removing) ability after repetitive use of cleaner 10 according to the present embodiment. For example, the cut may be a line of long holes or wavy slits, intermittent slits such as a line of perforation, etc., or the like. Preferably, the cut is provided across the width direction (a direction perpendicular to the length direction) of PSA sheet 30. Alternatively, replacement of the lateral surface (working surface) of the PSA body is not limited to the cutting means, but for instance, intermittent slits such as a line of perforation may be formed spirally in a direction intersecting the winding direction of PSA sheet roll 30 (typically, in a direction intersecting the width direction at an angle of 30° to 60°). Alternatively, instead of intermittent slits such as a line of perforation, PSA sheet 30 constituting PSA sheet roll 30 may comprise a slit (a continuous cut) at a prescribed interval. According to this embodiment, by peeling off the lateral surface (working surface) of the PSA body fully cut in advance at a prescribed interval over the winding direction of the roll, the working surface can be easily renewed.

From the standpoint of costs, the ease of disposal, cushioning property, etc., as support 20 of cleaner 10 according to the present embodiment, a substrate made of paper (typically made of cardboard) can be used preferably. Alternatively, support 20 may be made of a different material (e.g., a polyolefin-based synthetic resin or any other synthetic resin).

Although there are no particular limitations to the size of cylindrical support 20, as it may vary depending on the shape or the size of a flat plate surface (e.g., a display of A4 size, A5 size, A6 size, B4 size, B5 size, or B6 size) provided in a subject product (e.g., a portable device), the support has a diameter (referring to the outside diameter; the same applies hereinafter) of suitably 4 mm or larger, or preferably 10 mm or larger (e.g., 20 mm or larger). When the PSA plate surface cleaner is small-sized (e.g., pen-sized), the support may have a diameter smaller than 4 mm, for instance, about 1 mm to 3 mm. Support 20 and a PSA body (PSA sheet roll) placed on the lateral surface of the support combined has an overall diameter of suitably 50 mm or smaller, or preferably 35 mm or smaller (although this is not to exclude a roll diameter larger than 50 mm). By employing cylindrical support 20 having a diameter in such a numerical range and PSA body (PSA sheet roll) 30, a flat glass or synthetic resin plate surface (typically a display-input screen) of a mobile size (e.g., a size of A4 to A6 or B5 to B6) provided in portable device 1 as shown in FIG. 1 can be efficiently and quickly cleaned (removed of dirt).

The PSA sheet roll may be of a so-called coreless-type, formed by winding PSA body 30 into a roll without use of support (roll core) 20. In this case, head spindle 44 of handle member 40 can be placed centrally through the roll of PSA body 30.

Figure 4:
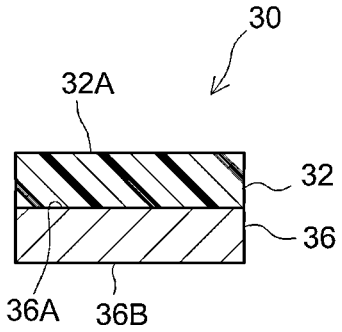
FIG. 4 shows a cross-sectional view schematically illustrating an example of a constitution of a PSA body provided in a PSA plate surface cleaner according to an embodiment of the present invention

As shown in FIG. 4, PSA body (PSA sheet roll) 30 of cleaner 10 according to the present embodiment is constituted such that it has a bi-layered structure comprising a long sheet (a band) of substrate 36 and PSA layer 32 formed of PSA held on a face 36A of substrate 36, and is wound around support 20 to form a roll with outer surface (i.e., adhesive face) 32A of PSA layer 32 facing the outside (i.e., the lateral surface side of the roll).

Substrate 36 is typically constituted with a synthetic resin of various types, a non-woven fabric, or paper. It can be a fabric, a rubber sheet, a foam sheet, metal foil, a composite of these, or the like.

Examples of a synthetic resin include polyolefins (polyethylene, polypropylene, ethylene-propylene copolymers, etc.), polyesters (polyethylene terephthalate, etc.), vinyl chloride resin, vinyl acetate resin, polyimide resin, polyamide resin, fluororesin, and the like. In particular, a substrate made of polyethylene terephthalate (PET) can be preferably used.

Examples of paper include Washi, kraft paper, glassine paper, high-grade paper, synthetic paper, top-coated paper, and the like. Examples of a fabric include a woven fabric and a non-woven fabric of a single species or a blend, etc., of various fibrous substances. Examples of the fibrous substance include cotton, staple fiber, Manila hemp, pulp, rayon, acetate fiber, polyester fiber, polyvinyl alcohol fiber, polyamide fiber, polyolefin fiber, and the like. Examples of a rubber sheet include a natural rubber sheet, a butyl rubber sheet, and the like. Examples of a foam sheet include a polyurethane foam sheet, a polychloroprene rubber foam sheet, and the like. Examples of metal foil include aluminum foil, copper foil, and the like. Substrate 36 may contain as necessary various additives such as filler (inorganic filler, organic filler, etc.), anti-aging agent, anti-oxidant, UV ray absorbing agent, photostabilizing agent, anti-static agent, lubricant, plasticizer, colorant (pigment, dye, etc.), and the like.

Back face 36B of substrate 36 may have been subjected to a surface treatment (typically, a release treatment to prevent an excessive unwinding force) such as coating with a silicone-based release agent, etc., in order to adjust the unwinding force of PSA sheet roll 30.

The thickness of substrate 36 can be suitably selected according to the purpose, not subject to any particular limitation. In general, it is suitable that substrate 36 has a thickness of about 20 μm to 200 μm (typically about 30 μm to 100 μm).

PSA body 30 (PSA layer 32) of PSA plate surface cleaner 10 disclosed herein preferably has an adhesive strength suitable for trapping dust and dirt (especially organic dirt) accumulated on plate surface 2 to the PSA body 30 side while a user allows cleaner 10 to contact plate surface 2 to be cleaned with applying a suitable pressing force (e.g., with the user applying a pressing force of 100 g to 1200 g (typically 200 g to 500 g) against the cleaner) and moves the cleaner into a prescribed direction at a suitable moving speed (rolling speed in case of a roller cleaner), for instance, 0.1 m/s to 0.5 m/s.

Although not particularly limited, the PSA body has an adhesive strength of suitably about 1 N/25 mm to 7 N/25 mm, or preferably about 1.3 N/25 mm to 6.5 N/25 mm as a measured value based on the 180° peel test specified in JIS Z0237. With such an adhesive strength, smooth movement (rolling) of cleaner 10 (i.e., PSA body 30) on plate surface 2 and consistent dirt-removing ability can be combined. Alternatively, with emphasis placed on the maneuverability (typically low rolling resistance), the adhesive strength may be about 0.05 N/25 mm or greater (e.g., 0.1 N/25 mm or greater, typically 0.5 N/25 mm or greater). An adhesive strength too far below such a level is not preferable because the dirt and dust removing ability essentially expected in cleaner 10 is reduced. On the other hand, an adhesive strength too far above this level is not preferable because it makes it difficult to move cleaner 10 (PSA body 30) on a subject flat plate surface or to remove cleaner 10 from plate surface 2.

In PSA body (PSA sheet roll) 30 disclosed herein, it is preferable that the adhesive strength (e.g., the measured value based on the 180° peel test is 1 N/25 mm to 7 N/25 mm) and the unwinding force are in a balance so that the occurrence of rail drawing on plate surface (e.g., plate surface made of glass such as aluminosilicate, etc., or a synthetic resin) 2 is deterred for PSA body (PSA sheet roll) 30. Unwinding force herein refers to a force required for pulling out a PSA sheet from the PSA sheet roll (i.e., it can be understood also as a resistive force against unwinding, or an adhesive strength against back face 36B of substrate 36). For instance, too low an unwinding force as compared to the adhesive strength is not preferable because when rolling PSA sheet roll 30 on flat plate surface 2, rail drawing may occur because the unwinding force yields to the adhesive strength between PSA body 30 and plate surface 2. On the other hand, too high an unwinding force is not preferable, either, because smooth pull-out of the PSA sheet becomes difficult to achieve.

The unwinding force can be evaluated as follows. That is, it can be determined by setting PSA sheet roll 30 in a prescribed tensile tester; at an atmospheric pressure (e.g., in an atmosphere at a temperature of 23° C. and 50% relative humidity), placing the end on the outer surface side of the wound PSA sheet on the chuck of the tensile tester, and unwinding the PSA sheet roll into the tangential direction by pulling it at a prescribed speed (e.g., 300 mm/min); and converting the unwinding force measured then to a value (N/150 mm) per a prescribed width (e.g., 150 mm) of PSA layer 32. For instance, the PSA sheet roll preferably has an unwinding force of about 0.5 N/150 mm to 2.5 N/150 mm.

The thickness of PSA layer 32 can be selected according to the purpose, not subject to any particular limitation. In general, PSA layer 32 suitably has a thickness of about 30 μm to 300 μm (typically about 50 μm to 150 μm). As the thickness of PSA layer 32 increases, the amount of substances such as sedum, etc., that the PSA layer can trap increases, whereby the recovery of dirt-catching ability tends to become better. Alternatively, when PSA layer 32 is made thinner, its weight and size can be reduced, thereby increasing its maneuverability and portability.

PSA layer 32 may be formed over an entire area of a face of substrate 36; or as shown in FIG. 2, substrate 20 may comprise, along the two edges across the width direction, non-adhesive portions (dry edges) 37 and 38 where PSA layer 32 is not formed. PSA layer 32 is typically formed evenly and continuously (applied fully) over an entire area of substrate 36 or over an area excluding non-adhesive portions 37 and 38 as shown in FIG. 2.

Figure 5:
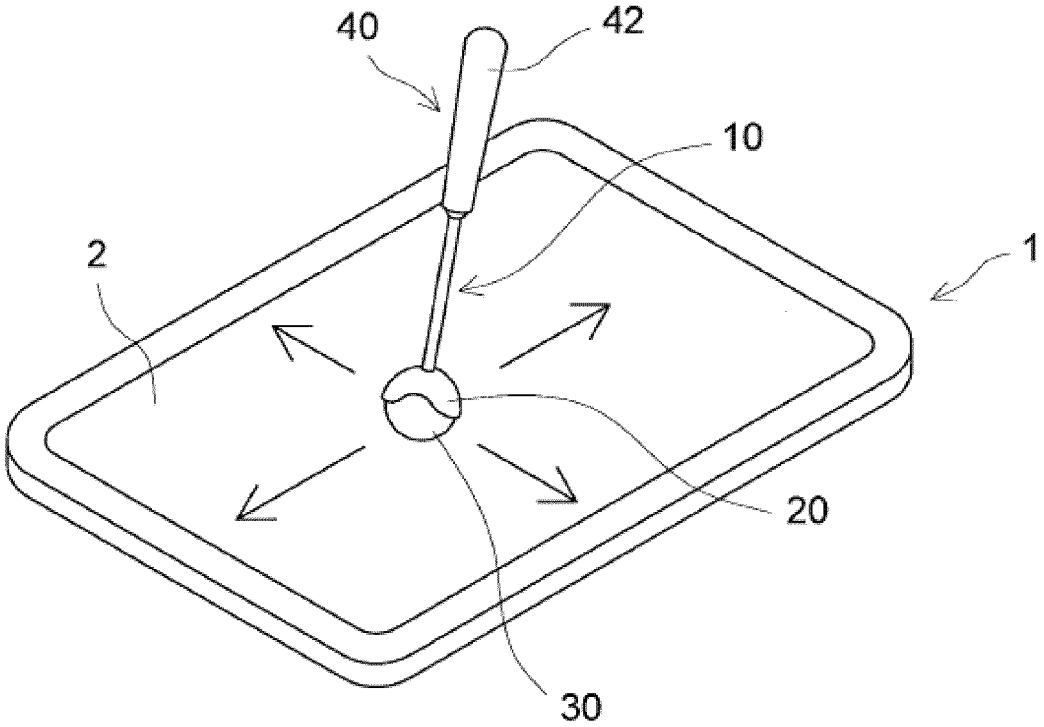
FIG. 5 shows a perspective view schematically illustrating an example of usage of a PSA plate surface cleaner according to another embodiment of the present invention.

Cleaner 10 according to a second embodiment is described next with reference to FIG. 5. As shown in FIG. 5, cleaner 10 according to the present embodiment comprises nearly spherical PSA body 30, support 20 for supporting part (typically an upper portion) of PSA body 30, and a handle member 40 attached to support 20. PSA body 30 may be a ball consisting of a PSA, or may comprise a PSA layer formed on the surface of a hollow or solid spherical substrate. Support 20 comprises a curved surface complementary to the spherical shape of PSA body 30 and rollably supports PSA body 30. The form of support 20 may be described as semispherical. Handle member 40 is an elongated bar member, with one end thereof being fixed to support 20 and the other end comprising a handheld portion 42. With such a constitution, when an operator (not shown) holds handheld portion 42 of cleaner 10 and moves (rolls) spherical PSA body 30 into a desirable direction (in the direction shown by an arrow in FIG. 5) on plate surface 2 of portable device 1, PSA body 30 catches dust and organic dirt present on plate surface 2. In this way, cleaning (dirt-removal) of plate surface 2 can be carried out efficiently and quickly. The diameter of spherical PSA body 30 is not particularly limited, but it is suitable to be about 5 mm to 50 mm (e.g., 10 mm to 40 mm, typically 20 mm to 30 mm). Since matters besides these can be basically the same as the first embodiment, they are not described over again here.

The PSA plate surface cleaner is not limited to the embodiments described above. For example, the PSA plate surface cleaner may constituted solely with a PSA. Examples of such a PSA plate surface cleaner include cleaners constituted solely with a PSA body having a spherical shape, a columnar shape, a hexahedral shape (e.g., a cuboidal shape), or any other shape. Alternatively, the cleaner may comprise the spherical PSA body and a support for supporting the PSA body. Such a support may be directly or indirectly attached (connected or detachably attached) to the PSA body. Examples of such a PSA plate surface cleaner include a cleaner where a columnar or cuboidal PSA body is fixed to one end of a support bar. Alternatively, the cleaner may comprise a flat support, with one face thereof having a PSA layer formed of a PSA body and the opposite face having a hold. The hold of such a PSA plate surface cleaner is formed into a belt shape, and the two ends thereof may be fixed on a support. An operator can maneuver the PSA plate surface cleaner by holding it so as to insert a hand at least partially (typically a few fingers) through a ring formed with the hold and the support. Alternatively, the cleaner may comprise a layered material (PSA body) comprising several overlaid PSA layers in sheets, with the layered material being supported by a support. The layered material may comprise at least a first layer and a second layer. According to such a PSA plate surface cleaner, when the dirt-removing ability of the outermost PSA layer (first layer) is reduced as a result of its uses, this PSA layer (first layer) can be peeled off to expose a PSA layer (second layer) different from the first layer, and dirt-removal can be carried out with this second layer. The back face of such a PSA layer (first layer) may comprise a substrate sheet formed of PET film, etc., and one surface (e.g., the surface to contact the second layer surface) of the substrate may have been subjected to a silicone-based release treatment.

The composition (components) of the PSA constituting PSA body 30 (PSA layer 32) is not particularly limited as far as it has a preferable adhesive strength for the purpose of the present invention as described above and it is suitable for easy and efficient removal of organic dirt accumulation (e.g., accumulation of hand marks and sedum dirt of a person, or cosmetic components) on flat plate surface 2.

Examples of a preferable PSA include various types of solvent-based PSAs, aqueous (emulsion-based) PSAs, and the like. For the purpose of removing sedum dirt of a person, a solvent-based PSA is particularly preferable.

In terms of base polymers, preferable PSAs include acrylic PSAs, natural-rubber-based PSAs, urethane-based PSAs, silicone-based PSAs, and the like. In particular, acrylic PSAs, natural-rubber-based PSAs, urethane-based PSAs are preferable.

Among these, the PSA is preferably an acrylic PSA comprising as a base polymer (a primary component of polymer components, a primary adhesive component) an acrylic polymer. "Acrylic polymer" herein typically refers to a polymer (copolymer) synthesized by polymerizing a monomer material (a single monomer species or a monomer mixture) comprising an alkyl(meth)acrylate as a main monomer and possibly comprising a secondary monomer that is polymerizable with the main monomer. "(Meth)acrylate" comprehensively refers to acrylate and methacrylate. Similarly, "(meth)acryloyl" comprehensively refers to "acryloyl" and "methacryloyl", and "(meth)acryl" comprehensively refers to "acryl" and "methacryl".

As the alkyl(meth)acrylate, can be preferably used, for instance, a compound represented by the following formula:

$$CH_2{=}CR^1COOR^2$$

Herein, $R^1$ in the formula is a hydrogen atom or a methyl group. $R^2$ is an alkyl group having 1 to 20 carbon atoms (hereinafter, such a range of the number of carbon atoms may be indicated as "$C_{1-20}$"). From the standpoint of the storage elastic modulus, etc., of the PSA, it may be an alkyl(meth) acrylate wherein $R^2$ is a $C_{1-14}$ (e.g., $C_{1-10}$) alkyl group. The alkyl group may be a straight chain or branched.

Examples of the alkyl(meth)acrylate having a $C_{1-20}$ alkyl group include methyl(meth)acrylate, ethyl(meth)acrylate, n-propyl(meth)acrylate, isopropyl(meth)acrylate, n-butyl (meth)acrylate, isobutyl(meth)acrylate, s-butyl(meth)acrylate, n-pentyl(meth)acrylate, isopentyl(meth)acrylate, hexyl (meth)acrylate, heptyl(meth)acrylate, 2-ethylhexyl(meth) acrylate, n-octyl(meth)acrylate, isooctyl(meth)acrylate, n-nonyl(meth)acrylate, isononyl(meth)acrylate, n-decyl (meth)acrylate, isodecyl(meth)acrylate, undecyl(meth)acrylate, dodecyl(meth)acrylate, tridecyl(meth)acrylate, tetradecyl(meth)acrylate, pentadecyl(meth)acrylate, hexadecyl (meth)acrylate, heptadecyl(meth)acrylate, octadecyl(meth) acrylate, nonadecyl(meth)acrylate, eicosyl(meth)acrylate, and the like. These can be used as a single kind alone, or in combination of two or more kinds. Among these, n-butyl acrylate, n-butyl methacrylate, 2-ethylhexyl acrylate, and isononyl acrylate are preferable. For example, it can be, for instance, an acrylic polymer in which one, two or more kinds of these in a total amount greater than 50% by mass (e.g., 60% by mass or greater, but 99% by mass or smaller, typically 70% by mass or greater, but 98% by mass or smaller) are copolymerized.

The monomer material polymerized to obtain the acrylic polymer may comprise, in addition to a main monomer, a secondary monomer as a co-monomer that is copolymerizable with the main monomer for the purpose of improving various characteristics such as low rolling resistance, and so on. Such a secondary monomer encompasses not only a monomer, but also an oligomer as well.

Examples of the secondary monomer include monomers containing a functional group (which hereinafter may be referred to as functional-group-containing monomers). Such a functional-group-containing monomer may be added for the purpose of introducing crosslinking points into the acrylic polymer and increasing the cohesive strength of the acrylic polymer. Examples of such a functional-group-containing monomer include carboxyl-group-containing monomers, acid-anhydride-group-containing monomers, hydroxyl-group-containing monomers, amide-group-containing monomers, amino-group-containing monomers, epoxy-group (glycidyl group)-containing monomers, alkoxy-group-containing monomers, and alkoxysilyl-group-containing monomers. These can be used as a single kind alone, or in combination of two or more kinds. Among these, carboxyl-group-containing monomers and hydroxyl-group-containing monomers are more preferable because they can preferably introduce crosslinking points into the acrylic polymer and achieve an even higher cohesive strength in the acrylic polymer.

Examples of a carboxyl-group-containing monomer include ethylenic unsaturated monocarboxylic acids such as acrylic acid, methacrylic acid, crotonic acid, carboxyethyl (meth)acrylate, carboxypentyl(meth)acrylate, etc.; ethylenic unsaturated dicarboxylic acids such as itaconic acid, maleic acid, fumaric acid, citraconic acid, etc.; and the like. Among these, acrylic acid and/or methacrylic acid are preferable, and acrylic acid is especially preferable.

Examples of an acid-anhydride-group-containing monomers include acid anhydrides of the ethylenic unsaturated dicarboxylic acids listed above such as maleic acid anhydride, itaconic acid anhydride, etc.; and the like.

Examples of a hydroxyl-group-containing monomer include hydroxyalkyl(meth)acrylates such as 2-hydroxyethyl (meth)acrylate, 2-hydroxypropyl(meth)acrylate, 3-hydroxypropyl(meth)acrylate, 2-hydroxybutyl(meth)acrylate, 4-hydroxybutyl(meth)acrylate, etc.; unsaturated alcohols such as N-methylol(meth)acrylamide, vinyl alcohol, allyl alcohol, 2-hydroxyethyl vinyl ether, 4-hydroxybutyl vinyl ether, diethylene glycol monovinyl ether, etc.; and the like.

Examples of an amide-group-containing monomer include (meth)acrylamide, N,N-dimethyl(meth)acrylamide, N-butyl (meth)acrylamide, N-methylol(meth)acrylamide, N-methylolpropane(meth)acrylamide, N-methoxymethyl(meth)acrylamide, N-butoxymethyl(meth)acrylamide, and the like.

Examples of an amino-group-containing monomer include aminoethyl(meth)acrylate, N,N-dimethylaminoethyl(meth) acrylate, t-butylaminoethyl(meth)acrylate, and the like.

Examples of an epoxy-group (glycidyl group)-containing monomer include glycidyl(meth)acrylate, methylglycidyl (meth)acrylate, allyl glycidyl ether, and the like.

Examples of an alkoxy-group-containing monomer include methoxymethyl(meth)acrylate, ethoxyethyl(meth) acrylate, and the like.

Examples of an alkoxysilyl-group-containing monomer include 3-(meth)acryloxypropyltrimethoxysilane, 3-(meth) acryloxypropyltriethoxysilane, 3-(meth)acryloxypropylmethyldimethoxysilane, 3-(meth)acryloxypropylmethyldiethoxysilane, and the like.

When a functional-group-containing monomer listed above is used as a monomer constituting the acrylic polymer, it is preferable that the monomer material polymerized to produce the acrylic polymer comprises the functional-group-containing monomer (preferably a carboxyl-group-containing monomer) at 1 to 10% by mass (e.g., 2 to 8% by mass, typically 3 to 7% by mass).

The monomer material may comprise, as a secondary monomer, another monomer besides the functional-group-containing monomer for the purpose of increasing the cohesive strength of the acrylic polymer or other purposes. Examples of such a monomer include vinyl-ester-based monomers such as vinyl acetate, vinyl propionate, etc.; aromatic vinyl compounds such as styrene, substituted styrenes (α-methylstyrene, etc.), vinyl toluene, etc.; and the like.

In particular, preferable is an acrylic polymer (copolymer) comprising as a main monomer component an acrylic ester of various kinds such as 2-ethylhexyl acrylate, n-butyl acrylate, isononyl acrylate, etc., with the acrylic polymer being obtainable by mixing and copolymerizing the main monomer component with a functional-group-containing monomer such as acrylic acid, hydroxyethyl acrylate, acrylamide, glycidyl methacrylate, etc., or even with another monomer component (e.g., it contributes to modification of the cohesive strength) such as vinyl acetate, acrylonitrile, methyl methacrylate, methyl acrylate, styrene, or the like. Especially, an acrylic polymer comprising 2-ethylhexyl acrylate as a main monomer component is preferable.

The method for polymerizing the monomer or a monomer mixture is not particularly limited, and a general polymerization method heretofore known can be employed. Examples of such a polymerization method include solution polymerization, emulsion polymerization, bulk polymerization, and suspension polymerization. Among these, solution polymerization is preferable. The embodiment of the polymerization is not particularly limited and can be carried out with suitable selection of a heretofore known monomer supply method, polymerization conditions (temperature, time, pressure, etc.), and other components (polymerization initiator, surfactant, etc.) used besides the monomer. For instance, as the monomer supply method, the monomer mixture can be supplied to a reaction vessel all at once (all-at-once supply), or gradually supplied dropwise (continuous supply), or the mixture can be divided in several portions and each portion can be supplied at a prescribed time interval (portionwise supply). The monomer or the monomer mixture can be supplied as a solution or a dispersion containing part or all thereof dissolved in a solvent or emulsified in water.

The polymerization initiator is not particular limited, but for instance, examples include azo-based initiators such as 2,2'-azobisisobutylonitrile, etc.; peroxide-based initiators such as benzoyl peroxide, etc.; substituted ethane-based initiators such as phenyl-substituted ethane, etc.; redox-based initiators combining a peroxide and a reducing agent such as a combination of a peroxide and sodium ascorbate, etc.; and the like.

Although the amount of a polymerization initiator can be suitably selected in accordance with the type of the polymerization initiator, and the type of monomer (the composition of the monomer mixture), etc., it is usually suitable to select from a range of, for instance, about 0.005 part by mass to 1 part by mass relative to 100 parts by mass of all monomer components. The polymerization temperature can be, for example, around 20° C. to 100° C. (typically 40° C. to 80° C.).

Besides these, an emulsifier (a surfactant) such as an anion-based emulsifier, a nonion-based emulsifier, or the like and a heretofore known chain transfer agent of various types can be used as necessary.

In the PSA composition, a crosslinking agent is preferably added. With respect to this, forming a base polymer using a suitable crosslinking agent according to the monomer in use is not different at all from the conventional art. Preferable examples of a crosslinking agent for an acrylic PSA include organometallic salts such as zinc stearate, barium stearate, etc.; isocyanate-based crosslinking agents; epoxy-based crosslinking agents; and the like. Oxazoline-based crosslinking agents, aziridine-based crosslinking agents, metal-chelate-based crosslinking agents, and melamine-based crosslinking agents can also be used. Among these, isocyanate-based crosslinking agents and epoxy-based crosslinking agents are especially preferable because they can be preferably crosslinked to carboxyl groups and are likely to produce good maneuverability (typically low rolling resistance) and even good acid resistance as well. The amount of a crosslinking agent added is not particularly limited, but in order to achieve the adhesive strength in the preferable numerical value range, it can be about 0.01 to 10 parts by mass (e.g., 0.05 to 5 parts by mass, typically 0.1 to 5 parts by mass) relative to 100 parts by mass of all monomer components. Among the crosslinking agents, one kind can be used solely, or two or more kinds can be used in combination.

When a solvent-based PSA such as the acrylic PSA mentioned above is used, preferable examples of a solvent for use include aliphatic hydrocarbons such as hexane, heptane, mineral spirit, etc.; alicyclic hydrocarbons such as cyclohexane, etc.; aromatic hydrocarbons such as toluene, xylene, solvent naphtha, tetralene, dipentene, etc.; alcohols such as butyl alcohol, isobutyl alcohol, cyclohexyl alcohol, 2-methylcyclohexyl alcohol, tridecyl alcohol, etc.; esters such as methyl acetate, ethyl acetate, isopropyl acetate, butyl acetate, etc.; ketones such as acetone, methyl ethyl ketone, etc.; and the like.

The molecular weight (MW: weight average molecular weight) of the base polymer to be used (synthesized) is not particularly limited, but a polymer (e.g., an acrylic polymer) having a weight average molecular weight (MW) of approximately $30\times10^4$ to $100\times10^4$ can be used preferably.

A PSA preferable for practicing the present invention comprises a base polymer component such as an acrylic polymer, or a natural-rubber-based polymer, etc., as well as various optional components for adjustment of its physical properties.

For instance, a tackifier resin (tackifier) of various types is used for adjustment of the adhesive strength. A single species or a combination of two or more species can be used among general rosin-based, terpene-based, hydrocarbon-based (e.g., C5-based petroleum resins, C9-based petroleum resins, dicyclopentadiene-based petroleum resins), epoxy-based, polyamide-based, elastomer-based, phenol-based, ketone-based resins. For instance, a terpene-phenol resin can be used preferably as a tackifier.

Although the amount of a tackifier added is not particularly limited, in order to achieve an adhesive strength in the preferable numerical range, for instance, it can be 1 to 40 parts by mass, typically about 2 to 20 parts by mass (preferably 5 to 10 parts by mass) relative to 100 parts by mass of the base polymer.

As other optional components, various softening components such as plasticizer, processing oil, etc., may be contained. From the standpoint of increasing the dirt-removing ability of the PSA, it is preferable to add a plasticizer.

Preferable examples of a plasticizer include phthalate esters such as dioctyl phthalate, diisononyl phthalate, diisodecyl phthalate, dibutyl phthalate, etc.; adipate esters such as dioctyl adipate, diisononyl adipate, etc.; trimellitate esters such as trioctyl trimellitate, etc.; sebacate esters; and the like. In particular, adipate esters are preferable.

Although not particularly limited, the amount of a softening component (typically a plasticizer) added relative to 100 parts by mass of the base polymer is, for instance, suitably about 5 to 50 parts by mass, or preferably about 10 to 40 parts by mass (e.g., about 20 to 30 parts by mass). As the amount of the softening component (typically a plasticizer) increases, the dirt-removing ability (dirt-catching ability) of the PSA is more likely to recover. From such a standpoint, the amount of the softening component (typically a plasticizer) added relative to 100 parts by mass of the base polymer is preferably 20 parts by mass or larger (typically 20 to 70 parts by mass), or more preferably 30 parts by mass or larger (typically 30 to 50 parts by mass).

To the PSA constituting the PSA layer, various additives such as anti-aging agent, anti-oxidant, UV-ray-absorbing agent, photostabilizing agent, anti-static agent, colorant (pigment, dye, etc.) and the like can be further added. The types and the amounts of these additives as non-essential components can be similar to typical types and amounts used in a PSA of this type.

Figure 6:
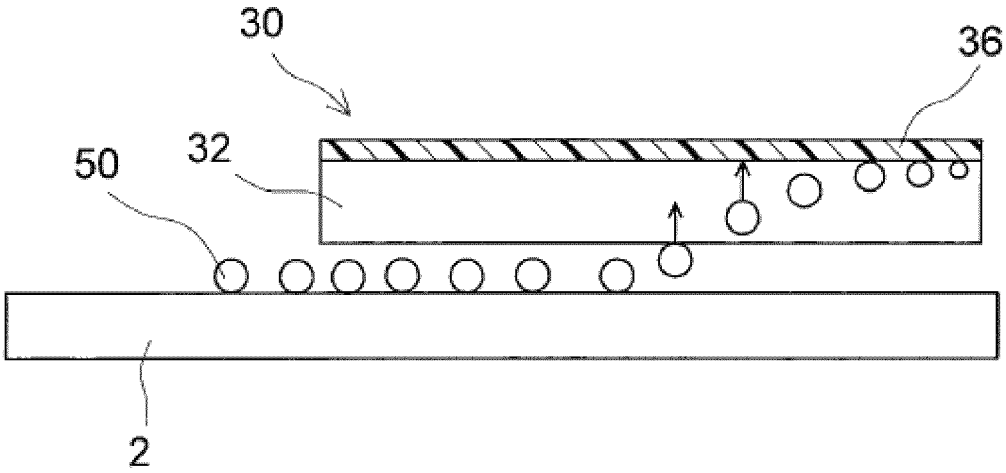
FIG. 6 shows a diagram schematically illustrating a mechanism of recovery of the dirt-removing ability of the PSA plate surface cleaner according to the present invention.

With respect to a PSA having a constitution described above, even if uses of the PSA plate surface cleaner result in a reduction in the ability (dirt-catching ability) to remove organic dirt such as hand marks and sedum, etc., of a person, it may restore its dirt-removing ability (dirt-catching ability) after a prescribed time period (e.g., a few minutes, or preferably a few hours) elapses. Such recovery mechanism is explained with reference to FIG. 6. As schematically shown in FIG. 6, when PSA layer 32 is allowed to contact plate surface 2 of a portable device, etc., PSA body 30 catches organic dirt 50 present on plate surface 2. This PSA layer 32 has a property not just to catch, but also to take up organic dirt 50 into the layer. Thus, organic dirt 50 caught on the surface of PSA layer 32 migrates over time to the interior of PSA layer 32, whereby the amount of organic dirt 50 present on the surface of PSA layer 32 is reduced, and eventually the surface of PSA layer 32 will be essentially free of organic dirt 50. In other words, the PSA plate surface cleaner restores its pre-use state. Thus, the "recovery mechanism" described above refers to a mechanism by which, when the PSA once catches dirt and suffers a loss of the dirt-catching ability, the dirt-catching ability recovers with a lapse of a prescribed time period (e.g., a few minutes, preferably a few hours), and the PSA becomes able to catch dirt again, with the mechanism including that the time period required for recovery of the dirt-catching ability is short.

PSA body 30 of cleaner 10 according to each preceding embodiment can be prepared by suitably employing a heretofore known means. For instance, PSA body 30 of cleaner 10 according to the first embodiment can be prepared in the same manner as for conventional roller cleaners. In other words, surface 36A of a long sheet of substrate 36 is coated with a PSA by various conventional coating methods, and a subsequent drying process can be carried out to form PSA layer 32. In addition, by winding PSA body 30 around support 20 such that PSA layer 32 forms the lateral surface, a roll of PSA body (i.e., PSA sheet roll) 30 can be formed. By detachably and rollably attaching the resulting PSA sheet roll 30 to head spindle 44 of handle member 40, cleaner 10 according to the first embodiment can be constructed. Since the way PSA sheet roll 30 is attached to head spindle 44 of handle member 40 can be the same as for a conventional roller cleaner and does not characterize the present invention at all, detailed description is omitted.

Several worked examples related to the present invention are described below. However, there is no intention to limit the present invention to such specific examples.

Example 1

As for a PSA, to a three-necked flask, were placed 2-ethylhexyl acrylate (2-EHA) and acrylic acid (AA) at a mass ratio of 2-EHA:AA=95:5 (with toluene used as a solvent), and was added benzoyl peroxide as a polymerization initiator under a nitrogen flow. The reaction mixture was heated to 60° C., and the reaction was carried out for two hours. The reaction mixture was further heated to 80° C., and the reaction was carried out for one hour to prepare a solution of an acrylic polymer having a weight average molecular weight (MW) of about $50\times10^4$ to $60\times10^4$. After this, relative to 100 parts by mass of the solid polymer content in the acrylic polymer solution, were mixed 5 parts by mass of a tackifier (terpene-phenol resin: "TAMANOL (registered trademark) 803L", a product of Arakawa Chemical Industries, Ltd.), 30 parts by mass of a plasticizer (diisononyl adipate: "MONOCIZER (registered trademark) W-242", a product of DIC Corporation) and 0.2 part by mass of a crosslinking agent (an epoxy-based crosslinking agent: "TETRAD (registered trademark) C", a product of Mitsubishi Gas Chemical Company) to prepare an acrylic PSA.

The resulting acrylic PSA was applied to a surface of a 38 μm thick PET substrate sheet (about 8 cm wide) and subjected to a drying treatment where it was passed through an oven at 80° C. to 120° C. to form a PSA layer of about 80 μm thickness (thickness of PSA).

The PSA body thus obtained was wound at least five times around the surfaces of a total of four different cylindrical cardboard supports having diameters (outside diameters) of 4 mm, 20 mm, 35 mm, and 50 mm, respectively to form a total of four different PSA sheet rolls. Each PSA sheet roll was rollably (rotatably) set on head spindle 44 of handle member 40 as shown in FIG. 1 to construct a cleaner according to Example 1.

Example 2

Using a PSA body (38 μm thick PET substrate+about 80 μm thick PSA layer) formed via the same procedures except that a commercially available solvent-based acrylic PSA (PSA whose main monomer component is 2-EHA: a product of Nitoms Inc.) of the same type was used in place of the acrylic PSA used in Example 1, were formed a total of four different PSA sheet rolls using supports of varied diameters (4 mm, 20 mm, 35 mm, 50 mm). In the same manner as Example 1, by rollably (rotatably) setting the respective PSA sheet rolls on head spindles 44 of handle members 40, cleaners according to Example 2 were constructed.

Example 3

Using a PSA body (38 μm thick PET substrate+about 80 μm thick PSA layer) formed via the same procedures except that a commercially available solvent-based natural-rubber-based PSA (rubber-based PSA containing as a main rubber component a natural rubber having a weight average molecular weight of $10\times10^4$ to $100\times10^4$: a product of Nitoms Inc.) was used in place of the acrylic PSA used in Example 1, were formed a total of four different PSA sheet rolls having supports of varied diameters (4 mm, 20 mm, 35 mm, 50 mm). In the same manner as Example 1, by rollably (rotatably) setting the respective PSA sheet rolls on head spindles 44 of handle members 40, cleaners according to Example 3 were constructed.

Example 4

Using a PSA body (38 μm thick PET substrate+about 80 μm thick PSA layer) formed via the same procedures except that a commercially available urethane-based PSA (PSA for removable/re-adherable double-faced tapes obtainable by polymerizing a polyol and a polyisocyanate: a product of Nitoms Inc.) was used in place of the acrylic PSA used in Example 1, were formed a total of four different PSA sheet rolls having supports of varied diameters (4 mm, 20 mm, 35 mm, 50 mm). In the same manner as Example 1, by rollably (rotatably) setting the respective PSA sheet rolls on head spindles 44 of handle members 40, cleaners according to Example 4 were constructed.

Example 5

Using a PSA body (38 μm thick PET substrate+about 80 μm thick PSA layer) formed via the same procedures except that a commercially available synthetic-rubber-based PSA (PSA for fixing artificial grass, containing butyl rubber as a main polymer (elastomer): a product of Nitoms Inc.) was used in place of the acrylic PSA used in Example 1, were formed a total of four different PSA sheet rolls having supports of varied diameters (4 mm, 20 mm, 35 mm, 50 mm). In the same manner as Example 1, by rollably (rotatably) setting the respective PSA sheet rolls on head spindles 44 of handle members 40, cleaners according to Example 5 were constructed.

Example 6

Using a PSA body (38 μm thick PET substrate+about 80 μm thick PSA layer) formed via the same procedures except that a commercially available hot melt PSA (PSA containing ethylene-vinyl acetate copolymer (EVA) as a main polymer (25% vinyl acetate content): a product of Nitoms Inc.) was used in place of the acrylic PSA used in Example 1, were formed a total of four different PSA sheet rolls having supports of varied diameters (4 mm, 20 mm, 35 mm, 50 mm). In the same manner as Example 1, by rollably (rotatably) setting the respective PSA sheet rolls on head spindles 44 of handle members 40, cleaners according to Example 6 were constructed.

Example 7

A conventional roller cleaner for flooring (trade name "COLOCOLO (registered trademark)": a product of Nitoms Inc.) was used as Example 7.

[Test for Evaluation of Adhesive Strength]

Using SUS304 as a specimen (adherend), the adhesive strength against the SUS surface was evaluated based on the 180° peel test specified in JIS Z0237.

In particular, the respective PSA bodies (cut to 25 mm width) provided on the cleaners according to Examples 1 to 7 were adhered to SUS304 plates, and in a measurement environment at 23° C. and 50% RH, the 180° peel strength (N/25 mm) was measured at a tensile speed of 300 mm/min. The results are shown in Table 1.

Table 1

| | Adhesive strength (N/25 mm) | | | |
|---|---|---|---|---|
| Sample | n = 1 | n = 2 | n = 3 | Average |
| Example 1 | 4.1 | 4.0 | 4.0 | 4.0 |
| Example 2 | 1.5 | 1.5 | 1.3 | 1.4 |
| Example 3 | 6.1 | 6.0 | 6.3 | 6.1 |
| Example 4 | 1.7 | 1.5 | 1.7 | 1.6 |
| Example 5 | 62.9 | 59.2 | 55.7 | 59.3 |
| Example 6 | not measured | not measured | not measured | N/A |
| Example 7 | 9.8 | 10.0 | 9.4 | 9.7 |

[Test for Evaluation of Sedum-Dirt-Removing Ability]

Using a tablet PC (iPad (registered trademark): a product of Apple Corporation) as a specimen, the ability to remove organic dirt (specifically, sedum dirt of a person) accumulated on the flat plate surface (made of aluminosilicate glass) of the tablet PC was examined.

In particular, a tester rubbed his hands and fingers against his face and other skin areas to collect sedum components deposited thereon, and rubbed and transferred the sedum components and sweat on his hands and fingers to part of the flat plate surface of the tablet PC. Such sedum and sweat were transferred in an amount to give rise to a gloss level (measured value) of approximately 60, using a handy gloss meter "GLOSS CHECKER (registered trademark) IG-331", a product of Horiba, Ltd., at a measurement angle of 60°.

Subsequently, with the cleaners according to Example 1 to Example 7, the PSA body (PSA sheet roll) of each cleaner was rolled over once on the plate surface (at a gloss level of about 60) having sedum dirt accumulation. The rolling speed was approximately 0.5 m/s. The pressing force applied by an operator during the rolling was approximately 300 g. The gloss level of the plate surface after the first run of rolling over was measured with the handy gloss meter, and the gloss level was used as an index of the sedum-dirt-removing ability. The results are shown in Table 2.

TABLE 2

| | Gloss level | | | | |
|---|---|---|---|---|---|
| Sample | 4 mm diameter | 20 mm diameter | 35 mm diameter | 50 mm diameter | Average |
| Example 1 | 95 | 95 | 95 | 94 | 95 |
| Example 2 | 92 | 94 | 94 | 90 | 93 |
| Example 3 | 89 | 90 | 91 | 91 | 91 |
| Example 4 | 91 | 92 | 93 | 93 | 93 |
| Example 5 | 84 | 88 | 83 | 86 | 86 |
| Example 6 | 67 | 70 | 63 | 66 | 66 |
| Example 7 | 84 | 85 | 85 | 83 | 84 |

Based on the results of these tests, with respect to the cleaners of Example 1 and Example 2 each comprising an acrylic PSA, the cleaner of Example 3 comprising a natural rubber-based PSA, and also the cleaner of Example 4 comprising a urethane-based PSA, it was confirmed that they had high sedum dirt removing abilities giving rise to gloss levels of 90 or higher. Especially, the cleaner of Example 1 exhibited high cleaning ability giving rise to an average gloss level of 95.

The cleaners of Example 1 to Example 4 exhibited each an adhesive strength of 1 N/25 mm to 7 N/25 mm (more specifically 1.3 N/25 mm to 6.5 N/25 mm) in the 180° peel test. Thus, the cleaners of Example 1 to Example 4 are roller cleaners that can be used in a highly convenient manner allowing a user to move (roll) them on a flat plate surface with a suitable rolling resistance (rotational resistance). Although no specific values being shown here, the rolling resistance (rotational resistance) can be determined such that at an atmospheric pressure (e.g., in an atmosphere at a temperature of 23° C. and 50% relative humidity), a tester holds handheld portion 42 in a state such as shown in FIG. 3 and allows the cleaner to roll on top of plate surface 2 at a prescribed speed (e.g., 725 mm/s) while keeping the angle between plate surface 2 and handle member 40 (handheld portion 42) constant (e.g., 55°); and the force (rotational resistance value) exerted on handheld portion 42 is measured with a digital force gauge, and the measured value is converted to a value (N/150 mm) per prescribed width (e.g., 150 mm) of PSA layer 32.

On the other hand, the cleaners of Example 5 to Example 7 exhibited gloss levels below 90 (average values of 66 to 86), and it was observed that they did not have sufficient sedum-dirt-removing ability.

The cleaners of Example 5 to Example 7 exhibited each an adhesive strength of about 10 N/25 mm to 60 N/25 mm in the 180° peel test; and as a significant resistance was experienced by a user when moving (rolling) over a flat plate surface, whereby it was confirmed that they were not suitable for this kind of purpose.

Example 8 to Example 13

As for a PSA, to a three-necked flask, were placed 2-ethylhexyl acrylate (2-EHA) and acrylic acid (AA) at a mass ratio of 2-EHA:AA=95:5 (with toluene used as a solvent), and was added benzoyl peroxide as a polymerization initiator under a nitrogen flow. The reaction mixture was heated to 60° C., and the reaction was carried out for two hours. The reaction mixture was further heated to 80° C., and the reaction was carried out for one hour to prepare a solution of an acrylic polymer having a weight average molecular weight (MW) of about $50\times10^4$ to $60\times10^4$. After this, relative to 100 parts by mass of the solid polymer content in the acrylic polymer solution, were mixed a plasticizer (diisononyl adipate: "MONOCIZER (registered trademark) W-242", a product of DIC Corporation) at a proportion shown in Table 3 and 0.1 part by mass of a crosslinking agent (an epoxy-based crosslinking agent: "TETRAD (registered trademark) C", a product of Mitsubishi Gas Chemical Company) to prepare an acrylic PSA according to each of Examples 8 to 13.

The resulting acrylic PSA was applied to a surface of a 38 μm thick PET substrate sheet (width: about 8 cm) and subjected to a drying treatment in an oven at 110° C. for three minutes to form a PSA layer of about 50 μm thickness (thickness of PSA).

The PSA body thus obtained was wound at least five times around the surface of a cylindrical cardboard support having a diameter (an outside diameter) of 20 mm to form a PSA sheet roll according to each of Examples 8 to 13. Each PSA sheet roll was rollably (rotatably) set on head spindle 44 of handle member 40 as shown in FIG. 1 to construct cleaners according to each of Examples 8 to 13.

[Test for Evaluation of Dirt-Removing Ability]

(Gloss Level)

The relationship between the amount of plasticizer used and the gloss level was investigated. In particular, a tester rubbed his hands and fingers against his face and other skin areas to collect sedum components deposited thereon, and rubbed and transferred the sedum components and sweat on his hands and fingers to part of the flat plate surface (made of aluminosilicate glass) of a tablet PC (iPad (registered trademark): a product of Apple Corporation). Such sedum and sweat were transferred in an amount to give rise to a gloss level (measured value) of approximately 60, using a handy gloss meter "GLOSS CHECKER (registered trademark) IG-331", a product of Horiba, Ltd., at a measurement angle of 60°.

Subsequently, with the cleaners according to Examples 8 to 13, the PSA body (PSA sheet roll) of each cleaner was rolled over once on the plate surface (at a gloss level of about 60) having sedum dirt accumulation. The rolling speed was approximately 0.5 m/s. The pressing force applied by an operator during the rolling was approximately 700 g. The gloss level of the plate surface after the first run of rolling over was measured with the handy gloss meter, and the gloss level was used as an index of the sedum-dirt-removing ability. Two testers carried out the evaluation test individually, and their average value was recorded.

Using glycerol monooleate (available from Kao Corporation, trade name "RHEODOL (registered trademark) MO-60") in place of the sedum components, the same test was carried out twice, and their average value was recorded. Glycerol monooleate was used as a substitute for sedum.

The results of the evaluations are shown in Table 3.

(Percentage of Dirt Removed)

The relationship between the number of cleaning runs and the percentage of dirt removed was investigated. In particular, in the same manner as the test for evaluation of sedum-dirt-removing ability, sedum components and sweat were rubbed and transferred onto part of the flat plate surface of a tablet PC. Such sedum and sweat were transferred in an amount to give rise to a gloss level (measured value) of approximately 60, using the handy gloss meter at a measurement angle of 60°.

With the cleaner according to Example 11, the PSA body (PSA sheet roll) of this cleaner was rolled over once (first cleaning run) on the plate surface (in particular, on the left half of the plate surface) having sedum dirt accumulation. The rolling speed was approximately 0.5 m/s. The pressing force applied by an operator during the rolling was approximately 700 g. The gloss level of the plate surface after the first run of rolling over was measured with the handy gloss meter. The measured value was taken as the gloss level after the first cleaning run.

Based on the equation below, the percentage (%) of dirt on the tablet PC removed by the cleaner according to Example 11 was determined:

$$\%\ \text{dirt removed}=(C-A)/(B-A)\times100$$

A: gloss level of the state with transferred sedum components and sweat

B: gloss level of the clean state measured in advance

C: gloss level after the first cleaning run

Following the measurement of the gloss level after the first cleaning run, the PSA sheet roll of the cleaner was rolled over once again (second cleaning run) on the plate surface (over the same area as the first cleaning run). The rolling speed and the applied pressing force were the same as the first run. The gloss level of the plate surface after rolled over was measured with the handy gloss meter. The measured value was taken as the gloss level after the second cleaning run. By substituting this measured value for C in the equation above, in the same way as after the first cleaning run, the percent (%) dirt removed after the second cleaning run was determined.

In the same manner as the first cleaning run and the second cleaning run, the third and the subsequent cleaning runs were carried out and the gloss levels were measured; and in the same way as after the second cleaning run, the percentages (%) of dirt removed after the third and the subsequent cleaning runs were determined. This was repeated until 100% of the dirt was removed.

Using glycerol monooleate (available from Kao Corporation, trade name "RHEODOL (registered trademark) MO-60") in place of the sedum components, the same test was carried out.

Figure 7:
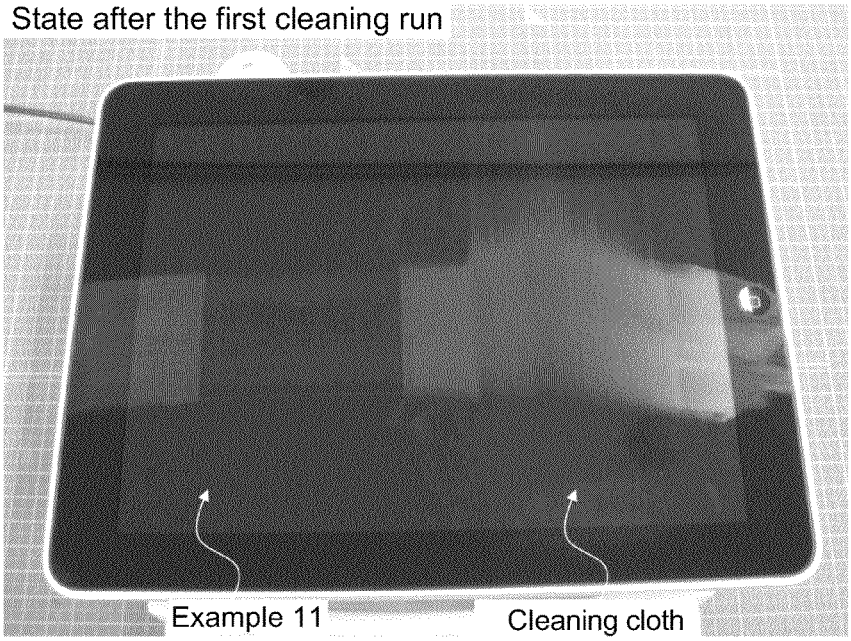
FIG. 7 shows a photo image of the state of a plate surface after the first cleaning run in a test to evaluate the percentage of dirt removed.
Figure 8:
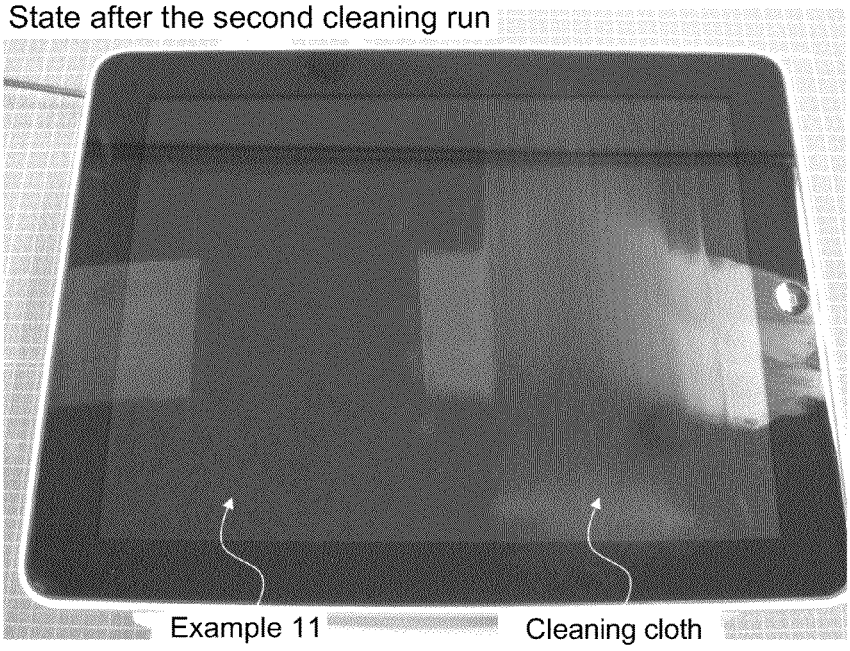
FIG. 8 shows a photo image of the state of a plate surface after the second cleaning run in a test to evaluate the percentage of dirt removed.
Figure 9:
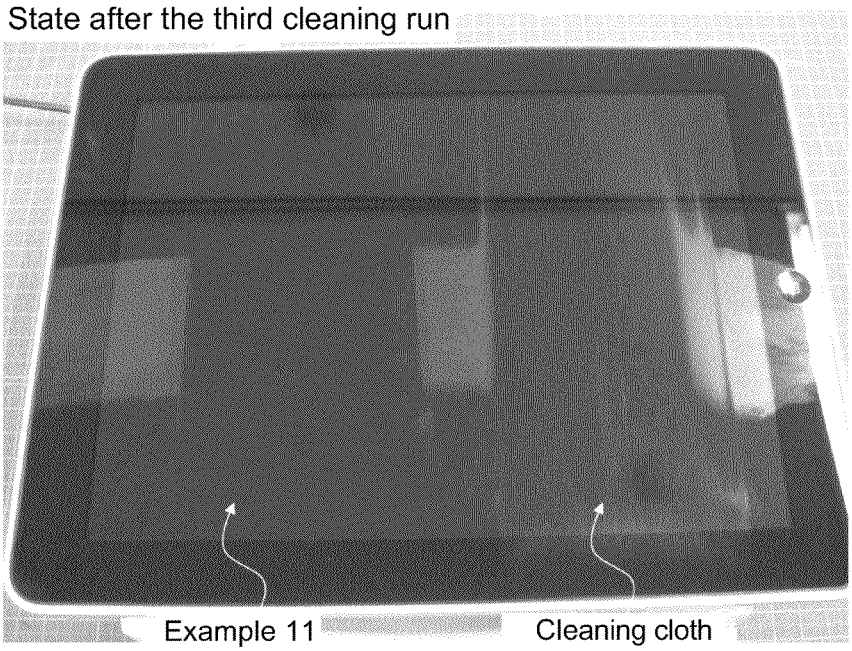
FIG. 9 shows a photo image of the state of a plate surface after the third cleaning run in a test to evaluate the percentage of dirt removed.

The results are shown in Table 4. FIGS. 7 to 9 show the post-cleaning states of the plate surface of the tablet PC upon the respective runs. In FIGS. 7 to 9, the left halves of the plate surface show the post-cleaning states achieved by the cleaner according to Example 11.

In the same manner as above, was obtained a tablet PC having a plate surface at a gloss level (measured value) of approximately 60 by depositing sedum dirt. Using a TV cleaning cloth (available from Hitachi Maxell, Ltd., large screen television cleaning cloth, dry type) in place of the cleaner according to Example 11, on a plate surface (in particular, on the right half of the plate surface) with sedum dirt accumulation, wiping was carried out once (first cleaning run) into the same direction as the rolling direction of the cleaner according to Example 11. The wiping speed was approximately 0.5 m/s. The pressing force applied by the operator during the wiping was approximately 700 g. The gloss level of the plate surface after wiped was measured with the handy gloss meter. This measured value was taken as the gloss level after the first cleaning run. Using this measured value, based on the equation above, the percentage (%) of dirt on the tablet PC removed by the cleaning cloth was determined.

Following the measurement of the gloss level after the first cleaning run, wiping was carried out again (second cleaning run) with the cleaning cloth into the same direction as the first run on the plate surface (over the same area as the first cleaning run). The wiping speed and the applied pressing force were the same as the first run. The gloss level of the plate surface after wiped was measured with the handy gloss meter. This measured value was taken as the gloss level after the second cleaning run. By substituting this measured value for C in the equation above, in the same way as after the first cleaning run, the percent (%) dirt removed after the second cleaning run was determined.

In the same manner as the first cleaning run and the second cleaning run, the third and the subsequent cleaning runs were carried out, and the gloss levels were measured. In the same way as after the second cleaning run, the percentages (%) of dirt removed after the third and the subsequent cleaning runs were determined. This was repeated until 100% of the dirt was removed.

Using glycerol monooleate (available from Kao Corporation, trade name "RHEODOL (registered trademark) MO-60") in place of the sedum components, the same test was carried out.

The results are shown in Table 4. FIGS. 7 to 9 show the post-cleaning states of the plate surface of the tablet PC after the respective runs. In FIGS. 7 to 9, the right halves of the plate surface show the post-cleaning states achieved by the cleaning cloth.

[Test for Evaluation of Adhesive Strength]

With respect to the PSAs according to Examples 8, 9, 11 and 13, using a tablet PC (iPad (registered trademark): a product of Apple Corporation) as a specimen (adherend), based on JIS Z0237, the adhesive strength against the plate surface (made of aluminosilicate) of the tablet PC was evaluated.

In particular, the PSA bodies (cut to 25 mm width) provided on the cleaners according to the respective examples were adhered to the plate surface of the tablet PC, and in a measurement environment at 23° C. and 50% RH, the 180° peel strength (N/25 mm) was measured at tensile speeds of 300 mm/min and 1000 mm/min. The measurement was carried out twice at each tensile speed and their average value was recorded. The results are shown in Table 5.

Table 3

| Sample | Plasticizer (parts by mass) | Gloss level sedum | Rheodol | Average |
|---|---|---|---|---|
| Example 8 | 0 | 87.0 | 88.0 | 87.5 |
| Example 9 | 10 | 90.0 | 91.0 | 90.5 |
| Example 10 | 20 | 90.5 | 92.5 | 91.8 |
| Example 11 | 30 | 91.0 | 92.0 | 91.5 |
| Example 12 | 40 | 90.5 | 91.5 | 91.0 |
| Example 13 | 50 | 91.0 | 92.5 | 91.8 |

TABLE 4

| Type of dirt | Application | % dirt removed 1st run | 2nd run | 3rd run | 4th run | 5th run | 6th run | 7th run |
|---|---|---|---|---|---|---|---|---|
| Sedum | PSA sheet roll | 92 | 97 | 100 | — | — | — | — |
| | Cleaning cloth | 53 | 94 | 94 | 94 | 94 | 97 | 100 |
| Rheodol | PSA sheet roll | 82 | 91 | 100 | — | — | — | — |
| | Cleaning cloth | 68 | 88 | 94 | 94 | 100 | — | — |

TABLE 5

| Sample | Plasticizer (parts by mass) | Peel strength (N/25 mm) Tensile speed 300 mm/min | Tensile speed 1000 mm/min |
|---|---|---|---|
| Example 8 | 0 | 4.95 | 6.85 |
| Example 9 | 10 | 1.80 | 3.02 |
| Example 11 | 30 | 0.84 | 1.35 |
| Example 13 | 50 | 0.58 | 0.84 |

As shown in Table 3, as the plasticizer content in the acrylic PSA increased, the gloss level tended to increase. Although no specific values are shown, it is noted that as compared to the PSA sheet roll of Example 8, the PSA sheet rolls according to Examples 9 to 13 each using a PSA containing a plasticizer exhibited lower rolling resistance (rotational resistance) values and better maneuverability. Furthermore, although no specific values are shown, it is noted that there was observed a tendency that as the plasticizer content decreased, the anchoring level became higher. In addition, as shown in Table 5, there was confirmed a tendency that as the plasticizer content increased, the adhesive strength became lower.

As shown in Table 4, the cleaner constructed with the PSA sheet roll according to Example 11 was able to completely remove the dirt on the plate surface of the tablet PC with three runs of rolling. On the other hand, with a commercially available cleaning cloth, five to seven runs of wiping were required to completely remove the dirt. In addition, from FIGS. 7 to 9, it can be seen that the wiping with the cleaning cloth resulted in spreading of the dirt. From these results, it can be seen that the PSA cleaner according to the present invention is highly practical.

[Test for Evaluation of Recovery of Dirt-Removing Ability]

(Amount of Dirt Caught)

(1) The PSA sheet roll of the cleaner according to Example 11 was rolled over for three minutes on a flat plate surface (made of aluminosilicate glass) of a tablet PC (iPad (registered trademark): a product of Apple Corporation) supplemented with a sufficient amount of glycerol monooleate (available from Kao Corporation, trade name "RHEODOL (registered trademark) MO-60") to transfer the glycerol monooleate to the PSA body of the cleaner. The pressing force was approximately 700 g.

(2) The weight of the cleaner at this time was measured, and the difference from the initial weight was recorded as the amount of glycerol monooleate caught. This was taken as the amount caught in the first run.

(3) At a one-minute interval immediately after the three minutes of rolling, the PSA sheet roll of the cleaner was rotated about quarterly with a pressing force of approximately 1 kg on a flat plate surface (in a clean state) of a tablet PC (iPad (registered trademark): a product of Apple Corporation) different from the one above, and the amount of glycerol monooleate transferred to the plate surface was visually observed. When no transfer was observed consecutively three times, the procedure (1) above was carried out once again; and the weight of the cleaner at this point was measured, and the difference from the first caught amount was recorded as the amount of glycerol monooleate caught. This was taken as the amount caught in the second run.

The visual observation of the transfer level was carried out on the following basis. In particular, the transfer levels of glycerol monooleate were rated to five levels in relative to each other, with the levels being indexed such that the lower the point, the heavier the transfer; and the higher the point, the lighter the transfer.

1 point: a heavy transfer was observed 2 points: some transfer was observed.

3 points: a light transfer was observed.

4 points: a slight transfer was observed.

5 points: no transfer was observed.

(4) The same procedures as (1) and (3) above were carried out to determine the amount caught in the third run.

(5) The same procedures as (1) and (3) above were carried out to determine the amount caught in the forth run. No visual observation of the transfer level was carried out at the forth run.

Figure 10:
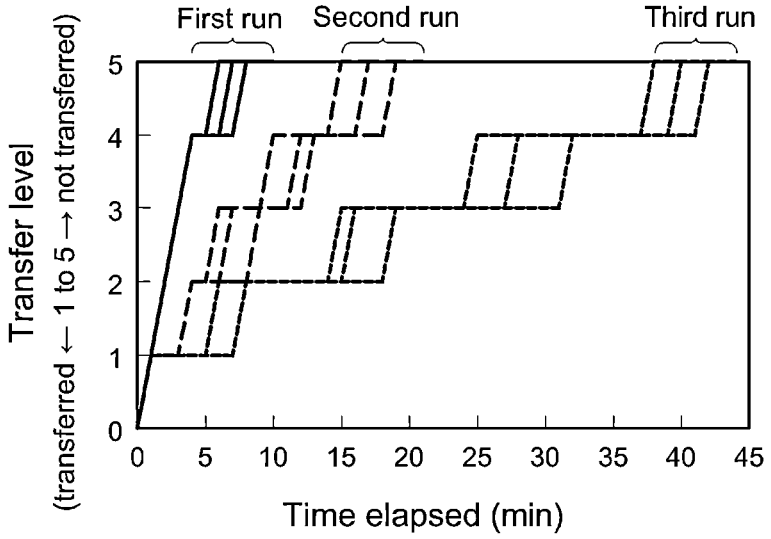
FIG. 10 shows a graph plotting the results of visual observation of transfer levels in a test to evaluate the amount of dirt caught.

With respect to the amount caught (mg), the evaluation was performed with three different samples, and their average value was taken. In addition, by dividing by the surface area of the PSA body of the PSA sheet roll, the amount caught per unit area (mg/cm$^2$) was determined. The results are shown in Table 6. The results of the visual observation of the transfer level are shown in FIG. 10.

(Recovery of Dirt-Catching Ability)

The relationship between the plasticizer content and the recovery of dirt catching ability was investigated.

(1) The PSA sheet rolls of the cleaners according to Example 8, 9 11 and 13 and a conventional floor roller cleaner according to Example 7 were rolled over respectively for three minutes on flat plate surfaces (made of aluminosilicate glass) of tablet PCs (iPad (registered trademark): a product of Apple Corporation) supplemented each with a sufficient amount of glycerol monooleate (available from Kao Corporation, trade name "RHEODOL (registered trademark) MO-60") to transfer the glycerol monooleate to the PSA bodies of the cleaners. The pressing force was approximately 700 g.

(2) The weight of the cleaner at this time was measured, and the difference from the initial weight was recorded as the amount of glycerol monooleate caught. This was taken as the amount caught in the first run.

(3) At a one-minute interval immediately after the three minutes of rolling, the PSA sheet roll of the cleaner was rotated about quarterly with a pressing force of approximately 1 kg on a flat plate surface (in a clean state) of a tablet PC (iPad (registered trademark): a product of Apple Corporation) different from the one above, and the amount of glycerol monooleate transferred to the plate surface was visually observed. When no transfer was observed consecutively three times, the procedure (1) above was carried out once again; and the weight of the cleaner was measured at this point, and the difference from the first caught amount was recorded as the amount of glycerol monooleate caught. This was taken as the amount caught in the second run.

Figure 11:
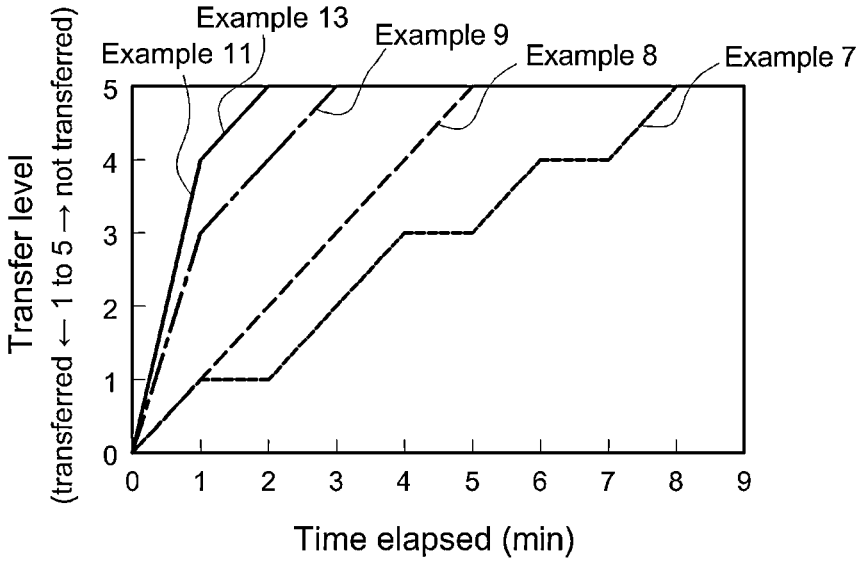
FIG. 11 shows a graph plotting the results of visual observation of transfer levels in a test to evaluate recovery of dirt-catching ability.

The visual inspection of the transfer level was carried out on the basis described above. With respect to the amount caught (mg), by dividing by the surface area of the PSA body of the PSA sheet roll, the amount caught per unit area (mg/cm$^2$) was determined. The results are shown in Table 7. The results of the visual observation of the transfer level are shown in FIG. 11.

TABLE 6

| | Amount caught | |
|---|---|---|
| | (mg) | (mg/cm$^2$) |
| 1st run | 20 | 0.41 |
| 2nd run | 12 | 0.25 |
| 3rd run | 11 | 0.24 |
| 4th run | 9 | 0.19 |

TABLE 7

| Sample | Plasticizer (parts by mass) | Amount caught at 1st run | | Amount caught at 2nd run | |
|---|---|---|---|---|---|
| | | (mg) | (mg/cm$^2$) | (mg) | (mg/cm$^2$) |
| Example 8 | 0 | 9 | 0.44 | 7 | 0.34 |
| Example 9 | 10 | 11 | 0.54 | 10 | 0.49 |
| Example 11 | 30 | 11 | 0.54 | 12 | 0.59 |
| Example 13 | 50 | 11 | 0.54 | 12 | 0.59 |
| Example 7 | — | 5 | 0.24 | 3 | 0.15 |

As shown in Table 6, the amount of glycerol monooleate caught by the cleaner according to Example 11 was as much as 20 mg. The same effects are expected against sedum of a person. As shown in Table 6 and FIG. 10, it can be seen that the cleaner can restore its dirt-catching ability without particularly removing the caught substances. Thus, with some resting time period after removing sedum or sweat on a tablet PC, it can be used again for many times.

As shown in Table 7, by adding a plasticizer to the PSA, the amount of dirt caught was increased. As shown in FIG. 11, there was seen a tendency that as the plasticizer content in the PSA increased, the time required for recovery of the dirt-catching ability was shortened. From these results, it can be said that with addition of a plasticizer to a PSA, the ability to catch organic dirt such as sedum, etc., increases. It can be also said that while the caught amount so increases, by increasing the plasticizer content, the recovery time of the dirt-catching ability can be shortened.

Although specific embodiments of the present invention have been described in detail above, these are merely for illustrations and do not limit the scope of the claims. The art according to the claims includes various modifications and changes made to the specific embodiments illustrated above.

REFERENCE SIGNS LIST

1 portable device
2 plate surface (display)
10 PSA plate surface cleaner
20 support
30 PSA body
32 PSA layer
36 substrate
40 handle member
42 handheld portion
44 head spindle
50 organic dirt

The invention claimed is:

1. A pressure-sensitive adhesive plate surface cleaner comprising a pressure-sensitive adhesive body that has a removable pressure-sensitive adhesive, the cleaner being used so as to allow the pressure-sensitive adhesive body to contact a flat plate surface of a plate having a flat surface in order to remove organic dirt accumulated on the plate surface, wherein the pressure-sensitive adhesive is an acrylic pressure-sensitive adhesive comprising an acrylic polymer in which an alkyl(meth)acrylate is polymerized in an amount greater than 50% by mass in a monomer constituent of the acrylic polymer, the alkyl(meth)acrylate represented by the following formula:

$$CH_2{=}CR^1COOR^2$$

wherein $R^1$ is a hydrogen atom or a methyl group and $R^2$ is an alkyl group having 1 to 20 carbon atoms, and the pressure-sensitive adhesive body has an adhesive strength of 7 N/25 mm or less to a stainless steel plate based on 180° peel test specified in JIS Z0237.

2. The pressure-sensitive adhesive plate surface cleaner according to claim 1, further comprising a support for supporting the pressure-sensitive adhesive body, wherein the support is constituted to hold the pressure-sensitive adhesive body such that while the pressure-sensitive adhesive is pushed against the plate surface, the pressure-sensitive adhesive body can be rolled along the plate surface.

3. The pressure-sensitive adhesive plate surface cleaner according to claim 2, wherein the support has a cylindrical form, with the cylindrical support comprising the pressure-sensitive adhesive body on its lateral surface, wherein the cylindrical support is designed to have an outside diameter of at least 4 mm or larger.

4. The pressure-sensitive adhesive plate surface cleaner according to claim 1, wherein the pressure-sensitive adhesive body comprises a substrate sheet and the pressure-sensitive adhesive is held on a face of the substrate sheet to form a pressure-sensitive adhesive sheet, with the pressure-sensitive adhesive body being constituted as a pressure-sensitive adhesive sheet roll wound with the pressure-sensitive adhesive on its outside.

5. The pressure-sensitive adhesive plate surface cleaner according to claim 4, wherein the substrate sheet is constituted with a synthetic resin, a non-woven fabric, or paper.

6. The pressure-sensitive adhesive plate surface cleaner according to claim 1 that is used for removing human sedum dirt as the organic dirt.

7. The pressure-sensitive adhesive plate surface cleaner according to claim 1, wherein the pressure-sensitive adhesive body has an adhesive strength of 1 N/25 mm to 7 N/25 mm as a measured value based on the 180° peel test specified in JIS Z0237.

8. The pressure-sensitive adhesive plate surface cleaner according to claim 1, wherein the plate is a portable device comprising as the flat plate surface a display screen made of glass or a synthetic resin, with the cleaner being used for removing organic dirt accumulated on the flat display screen made of glass or the synthetic resin.

9. The pressure-sensitive adhesive plate surface cleaner according to claim 1, wherein the pressure-sensitive adhesive body comprises a substrate sheet and the pressure-sensitive adhesive is on a face of the substrate sheet to form a pressure-sensitive adhesive sheet, with the pressure-sensitive adhesive body constituted as a pressure-sensitive adhesive sheet roll wound with the pressure-sensitive adhesive on its outside, and the pressure-sensitive adhesive body has a cut for separation.

10. The pressure-sensitive adhesive plate surface cleaner according to claim 1, further comprising:

a support supporting a part of the pressure-sensitive adhesive body; and a handle member attached to the support, and the pressure-sensitive adhesive body has a substantially spherical shape.

11. The pressure-sensitive adhesive plate surface cleaner according to claim 1, wherein the pressure sensitive adhesive body comprises a long substrate sheet and a pressure-sensitive adhesive layer formed above a face of the substrate sheet, and the substrate sheet has non-adhesive portions along two edges across the width direction, the non-adhesive portions being portions where the pressure-sensitive adhesive is not formed.

12. The pressure-sensitive adhesive plate surface cleaner according to claim 1, wherein the alkyl(meth)acrylate is at least one selected from the group consisting of 2-ethylhexyl (meth)acrylate, n-octyl(meth)acrylate, isooctyl(meth)acrylate, n-nonyl(meth)acryate, isononyl(meth)acryate, n-decyl (meth)acryate, isodecyl(meth)acryate, undecyl(meth) acryate, dodecyl(meth)acryate, tridecyl(meth)acryate, tetradecyl(meth)acryate, pentadecyl(meth)acryate, hexadecyl(meth)acryate, heptadecyl(meth)acryate, octadecyl(meth) acryate, nonadecyl(meth)acryate, and eicosyl(meth)acryate.

13. The pressure-sensitive adhesive plate surface cleaner according to claim 1, wherein the pressure-sensitive adhesive comprises a plasticizer.

14. The pressure-sensitive adhesive plate surface cleaner according to claim 1, wherein the pressure-sensitive adhesive comprises a plasticizer selected from the group consisting of a phthalate ester, an adipate ester, a trimellitate ester, and a sebacate ester.

15. The pressure-sensitive adhesive plate surface cleaner according to claim 1, wherein the pressure-sensitive adhesive comprises a base polymer and a plasticizer, and an amount of the plasticizer contained in the pressure-sensitive adhesive is 10 parts by mass or more relative to 100 parts by mass of the base polymer.

* * * * *